US007601100B1

(12) United States Patent
Hinds et al.

(10) Patent No.: US 7,601,100 B1
(45) Date of Patent: Oct. 13, 2009

(54) DOOR MOUNTED CHIN-UP ASSEMBLY

(76) Inventors: Robert Sylvester Hinds, 1211 Rutledge St., Madison, WI (US) 53703; Loyd William Bonneville, 1213 Amsterdam Ave., Madison, WI (US) 53716

( * ) Notice: Subject to any disclaimer, the term of this patent is extended or adjusted under 35 U.S.C. 154(b) by 0 days.

(21) Appl. No.: 12/119,518

(22) Filed: May 13, 2008

(51) Int. Cl.
*A63B 1/00* (2006.01)
*A63B 21/068* (2006.01)
*A63B 21/00* (2006.01)

(52) U.S. Cl. ..... 482/40; 482/95; 482/131; 482/904

(58) Field of Classification Search ..... 482/38–40, 482/95, 96, 126, 129, 131, 904
See application file for complete search history.

(56) References Cited

U.S. PATENT DOCUMENTS 1,706,654 A * 3/1929 Christesen ..... 482/125
4,419,990 A * 12/1983 Forster ..... 606/241
4,909,505 A * 3/1990 Tee ..... 482/129
5,730,687 A * 3/1998 Ledany ..... 482/121
5,921,903 A * 7/1999 Lawrence ..... 482/140
6,503,175 B1 * 1/2003 Harrell ..... 482/38
7,175,576 B2 * 2/2007 Felberg et al. ..... 482/140

* cited by examiner

*Primary Examiner*—Loan H Thanh
*Assistant Examiner*—Allana Lewin
(74) *Attorney, Agent, or Firm*—Craig A. Fieschko; DeWitt Ross & Stevens S.C.

(57) ABSTRACT

The equipment is considered in paired aspect, one construction for each of the exerciser's hands. In one arrangement, a strapping loop for each is respectively run through both of two tunneled components—a handhold and tethering anchor. To use it, the anchor is positioned on the opposing side at the top of a closed door so as to become trapped in place against the door and its frame. The exerciser grabs the handhold and performs chin-ups or other body suspension exercises by pulling upward along the door's face. A hand bracing assembly is optionally included to cushion the hands from excessive pressure against the door. If desired, the operator may also temporarily adapt the assembly to pull-type exercises.

10 Claims, 10 Drawing Sheets

DOOR MOUNTED CHIN-UP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

Exercise equipment

2. Description of Related Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term door impinged tethering anchor (14) might be used in one instance but in another, if meaning is otherwise clear from context, expression might be shortened to tethering anchor (14) or merely anchor (14). Any of those forms is intended to convey the same meaning.

The term attach or fasten or any of their forms when so used means that the juncture is of a more or less permanent nature, such as might be accomplished by nails, screws, welds or adhesives. Thus it is stated herein that the pad connector strap (26) connection to a bracing pad (20), if present, is one of attachment, for which purpose stitching at a sewn sector is the preferred means. A connection in which one object is easily removed from another is described by the word emplace, as where it is stated herein that the tethering anchor (14) is positioned by emplacement on the opposing side at the top of a closed door (200). A connection in which two objects, although not attached could be separated only with considerable difficulty is referred to herein as one of rigid emplacement. The passing or enreevement of the strapped loop (16) through connector eyelets (21), where that arrangement is employed, is stated herein to be such a connection. Employment of the words connect or join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the connection eyelets (21) may comprise a stitched sector (72), slits (82) or riveted rings (92), meaning that any member of the latter configurative group (72, 82 or 92, respectively) would in fact be the former (21). The term comprise may also be characterized by what might be considered one-way equivalency, as when it is stated herein that with respect to a given prior art reference, an enwrapped solid object such as tubing comprised the assembly's anchor (14), meaning that in the given instance, the enwrapped object was itself the anchor (14). This use of the word has a generic sense to it. That is, the enwrapped object so disposed would always have been a tethering anchor (14) but a tethering anchor (14) could have been an enwrapped object in one case but something else in another. However, the word comprise may also be used to describe a feature which is part of the structure or composition of a given object. Thus, the handhold and tethering assembly (1) is said to comprise, among other things, a tunneled handhold (11) as a component thereof. The meaning in the respective cases is clear from context, however. Accordingly, modifying words to clarify which of the three uses is the intended one seem unnecessary.

Terms relating to physical orientation such as top or bottom, upper or lower, refer to the positioning of the object—the handhold and tethering assembly (1), the hand bracing pad assembly (2) or the components of either—in the manner they would ordinarily be observed if positioned for use. This convention has been adopted as a matter of convenience in discussing orientation and as shown in the drawings, the tethering anchor (14) regarded as being brought to the top of the closed door (200), the pad connective strap (26) preferably disposed at the top or upper portion of the bracing pad (20), if present, and the operator's (100) fingers disposed over the top of the handhold (11); or conversely, the prior art sit-up devices illustrating means of retention either by what is herein designated door blocker obstruction, ante, or impingement at the bottom of a door (200) or the manner pad (20) might be permitted to slip downward on the strapping loop (16). Similarly, references to lateral are meant to designate the respective sides of an object, such as when connector eyelets (21) are said to be disposed as ears at the lateral pad edges (27) of any pad (20) included as an assembly constituent. Moreover, reference to the opposing side of a closed door (200) means the face thereof (200) other that upon which the operator (100) conducts the exercises.

As a further instance, the word affront with its derivations, a revival of the archaic, is used herein to denote the physical relationship between two objects, meaning that a first thereof is disposed very near or adjacent the second in what may be considered face-to-face orientation. It is, thus, said that the bracing pad (20), when present, comprises a door affronting face (28) and an oppositely disposed hand affronting face (29) and that in exercise, the operator's (100) hands are positioned in affrontment of the door (200). The expressions do not necessarily infer actual contact, which might better be described as abutment, as where it is said that the assembly is arranged to dispose the bracing pad's door affronting face (28) for abutment against the door (200). The usage of all of the foregoing terms of orientation must, of course, be interpreted so as to be equally understood regardless of what attitude the assembly is positioned.

Certain words have been coined herein to simplify discussion. In some cases, a verb is converted to a noun or adjective and, perhaps, vice-versa. For example, enreeve or derivations thereof such as enreevement stem from the word reeve and are used as a shorthand expression to more conveniently describe an arrangement in which an elongated object is inserted through a given opening. The same is true of enwrapment, stemming from the word enwrap, in which one object is circumscribed within a covering enclosure; or the word enclampment as an expression of the function of clamping devices. The term strap intersection or strap intersection site identifies the meeting place of the end of one strap with some portion of another, such as might be formed, for example, where two separate assemblies had their ends interconnected to one another by means of strapping. The terms attachment sector and sewn sector identify the site a given attachment is made, the latter referring specifically to a stitched connection upon a strap or straps. The meanings of such terms are generally explained ante.

The word tunnel is another example of noun and verb inter-conversion. In familiar parlance, it denotes an elongated cavity or hollow within an object. It is often used equally well as a verb herein, however, with tunnels or tunneled as variations in expression—in much the same manner one might speak of a hollowed longitudinal object. The tunneled handhold (11) and tunneled handhold core (12) are, accordingly, addressed at some length ante.

The term door (200) mounted, door (200) retained or door (200) anchored refers to well-known conventions wherein an exercise assembly is connected to a door (200) in one manner or another—often, as we have seen, by adopting some means of door blocker obstruction or impingement to that end.

As generally known, the word impinge itself, or forms thereof, address means of retention, such as result from squeezing or the application in some manner of tensioning forces against it. Its meaning is distinguished from door blocker obstruction in which an object is positioned to offer trapping restraint to a tethering anchor (14) at the opposing side of the door (200). While retention by reason of impingement results partly from pinching portions of the strapping loop (16) between the door (200) and door frame (201), door blocker obstruction results by reason of the inability to pull the tethering anchor (14) through even a wider crack between them (200, 201).

The word strapping, as used herein, denotes any composition amenable to being formed into a reasonably strong strap. Preferably, it comprises a woven fabric but may, nevertheless be composed of plastic or other materials. In that respect, a selected plastic must accommodate sewn stitch-work satisfactorily should such means be used for connection.

The term "chin-up" is now a commonly recognized one describing a physical exercise in which the operator (100) grasps a reliably secured overhead support structure—often a horizontal cross-bar or limb—and, by pulling upward, releases his or her (100) weight from all underlying support, raising the body to an objective level, such as by bringing the chin to a point proximate the overhead support. It is a general practice to perform the exercise in repetition.

The grasping effort may be undertaken in either of two ways. Most popularly, perhaps, the exercising operator's (100) hands are oriented with the fingers—curled, as they are, over the top of the handhold (11), the body's support structure-point forward, away from the body. However, the grip may be reversed so that the curled fingers are directed back toward him or her (100). In instances in which the overhead support comprises freely twisting paired handholds—rings or the sort—it is not uncommon to incur torque forces which turn the forearms and wrists inward toward one another either in supination or pronation, respectively, depending upon which grip modality is employed. It is a phenomena one might not unreasonably seek to avoid, depending of course, upon personal preference. I should not be overlooked that although chin-up exercises are usually conducted with the operator (100) facing the body's support structure, he or she (100) may alternatively face away from it with the hands grasping a little behind the head. Again, the fingers may be turned either way—again, depending upon personal preference.

Chin-ups may, of course, be conducted upon the support of a horizontal bar—or, for that matter, even upon a tree limb. Some have even performed them upon separate lateral means of support—that is, with the left hand supported by a structure separated from that for the right—much in the manner separately anchored distal pull-type exercises might be performed. Where they are undertaken against a vertical surface—a wall or door (200), as contemplated herein, or the like—and the operator's (100) hands affronting the surface (200) are permitted to repose in pressured abutment against it (200)—the resulting torque may be partially overcome. Nevertheless, the inclusion of a cushioning pad between the operator's (100) first and the door (200) has been observed to provide some relief from awkward contact which might otherwise reduce the efficacy of the exercise.

Over the course of time, other sorts of body lifting or supporting exercises were adopted, some even prescribed for therapeutic purposes—spinal traction and the like.

The history of door (200) anchored exercise assemblies is indeed an overcrowded one. Nonetheless, the especially current societal focus upon human body development—at times seeming even to border upon narcissism—disposes the field as a profitable one worthy of continuing structural nuances. Despite such near-excessive popularity, even small changes are gladly welcomed. Where door (200) mounted assemblies are considered, it is first appropriate to resolve the relevant prior art into two major groups—that in which the exercise assembly is tethered proximal the anchoring site and that in which the tethering is distal that site. A proximally anchored assembly would be one in which only a very short lead extends from the anchoring point to the operator (100) and is, therefore, highly suitable for chin-up exercises. Because there is very little history of hardware associated in particular with chin-ups, the subject matter must for the most part be evaluated collectively from numerous parallel references.

Somewhat of interest and shown here merely for the sake of putting matters into perspective were a large number of assemblies tethered distal the anchoring site. They were U.S. Pat. No. 2,938,695 issued to Ciampa, U.S. Pat. No. 3,608,900 issued to Welch; U.S. Pat. No. 4,060,240 issued to Dunston; U.S. Pat. Nos. 4,779,867 and 5,505,677 issued to Hinds; U.S. Pat. No. 5,549,532 issued to Kropp; U.S. Pat. No. 5,556,369 issued to Roberts; U.S. Pat. No. 5,571,064 issued to Holm; U.S. Pat. Nos. 5,781,422 and 5,839,994 issued to Elbogen; U.S. Pat. No. 6,059,698 issued to Mazor; U.S. Pat. No. 6,102,837 issued to Hubbard; U.S. Pat. No. 6,183,403 issued to Dunn; U.S. Pat. No. 6,450,929 issued to Markham; U.S. Pat. No. 6,494,817 issued to Lake; U.S. Pat. No. 6,524,226 issued to Kushner; U.S. Pat. No. 6,612,972 issued to Reichard; U.S. Pat. No. 6,662,651 issued to Roth; and U.S. Pat. No. 6,726,666 issued to Jacobsen. Those comprised elongated exercise cords, in most cases stretchable ones. However, in Dunston, Welch, Hubbard, Lake, Kushner, Reichard, Elbogen and Roth—though only preferably in the latter—the cord or strap was non-stretchable. In the later Hinds patent, Markham and by option in Jacobsen, the tethering strap was not impinged by the door (200) but rather looped around a doorknob for its connection. Some sort of strap retention—generally either impingement or door blocker obstruction—between the door (200) and its frame (201) was relied upon throughout most of that class of assemblies. Mazor, Lake and Reichard were three exceptions, in which a form of door (200) edge enwrapment by an unyielding brace-like anchor was employed in place of strapping. Most employed a thickened section of the strap to lock the assembly in place overhead. This was true of Dunn, although his impingement was directed to use in an automobile. In Roberts and Kushner the strap was knotted, while Jacobsen's optionally employed a tied bow. Interesting enough, however, Dunston and Welch comprised enwrapped solid objects—tubing and the like—for the anchor. The Roberts assembly also included a strap enreeved handhold, a feature similarly provided for stretchable cord in U.S. Pat. No. 5,514,059 issued to Romney. One of the Roberts embodiments, while affording only limited discussion therein, provided for a proximately tethered assembly, further considered ante.

Of somewhat more pertinence was a group of proximately tethered bottom-of-the-door anchored devices created to facilitate sit-up type exercises by means of foot retention. Although they were dedicated to a different sort of exercise, the similarity in function is not difficult to perceive. Thus, what was proximately anchored by door blocker obstruction at the bottom of the door (200) might equally well have been installed at the top with appropriate chinning handholds substituted for the foot straps. Those were U.S. Pat. No. 4,121,825 issued to Hult; U.S. Pat. No. 4,593,902 issued to Michaelsen; U.S. Pat. No. 4,602,782 issued to Carlson; and U.S. Pat. No. 4,705,270 issued to Melton. As would have been appropriate for a chin-up assembly, all four featured solid anchoring members in associative arrangement with a short tethering strap.

In U.S. Pat. No. 4,419,990 issued to Forster, however, another proximal arrangement, the door blocker obstruction was disposed at the top of the door (200) in a manner which, had it then been considered, would have been suitable for chin-ups. The assembly provided no handholds but instead included foot-pegs with cushioning pads to permit the operator to hang upside down for physiological traction. Following the reasoning applied to the sit-up assemblies, supra, chin-up handholds might feasibly have been substituted for the foot-pegs.

There were two patents worth mention which disclosed devices specifically dedicated to chin-ups. U.S. Pat. No. 5,776,033 issued to Brown and U.S. Pat. No. 6,503,175 issued to Harrell featured tools for the assembly's overhead enclampment upon a door frame (201). In both, the operator's (100) tug upon the mechanism in performing the chin-up tightened the vice-like clamping grip in self-enhancing functionality. Any assembly created solely to permit chin-ups, of course, constituted one in which the exercise tension site is proximate the anchoring site. The first of those two is relevant only in the vaguest sense, however, for it involved no tethering strap or cord whatsoever.

Interestingly, Ciampa, as an alternative arrangement, and U.S. Pat. No. 6,607,472 issued to Toole disclosed an overhead framework proximately braced in place by enwrapment hardware at the top of a closed door (200). In the latter case, the framework was body supporting. Closer still to the endeavor at hand in that proximal tethering was by impinged strapping were U.S. Pat. No. 4,419,990 issued to Forster and the Roberts patent, supra.

The proximate tethering concept briefly addressed in Roberts featured a somewhat cumbersome strapped system of connection rings and buckles but was, nevertheless, suitable for chin-up exercise.

It would be beneficial if the knotted, ringed and buckled proximately tethered embodiment of Roberts were modified by providing an additional strap-enreeved handhold, substituting it for the tethering anchor and then combining with that the simple proximal strapping arrangement and cushioning pads of Forster. Providing for the anchoring strap's enreement of the hollowed tethering anchors of Dunston, Hult and Michaelsen together with the Forster pads might achieve the same end. Such a construction would enhance its widespread availability by reason of manufacturing economies and would more readily encourage its frequent use because of its simple and aesthetic character. It would also be beneficial if one might temporarily adapt a chinning assembly also to distal exercise pull uses.

The multitude of door tethered exercise assemblies has surely gone far in fulfilling substantial physical fitness needs and objectives. Yet, those pointed out supra thus far remain only partly addressed in the prior art. So far as chin-up assemblies are concerned, the concern just immediately addressed has not been met at all.

BRIEF SUMMARY OF THE INVENTION

In the main, the invention provides in pairs-usually identical members thereof—a convenient door (200) mounted assembly with which to perform chin-ups and other body suspension exercises. Tt comprises a handhold and tethering assembly (1) which may or may not be employed additionally with a hand bracing assembly (2). Inclusion of the latter (2) provides a cushion for the operator's (100) hands. The overall arrangement also allows for inclusion of a pulling media subassembly (3) for distal pull-type exercises, should an operator (100) choose to perform them.

The favored assembly (1) comprises a tunneled handhold (11), a tunneled tethering anchor (15) and a strapping loop (16) enreeved through the handhold (11) and the anchor (15) at first and second loop sectors (17, 18, respectively). In use, the anchor (15) is positioned by emplacement on the opposing side at the top of a closed door (200) and lodged in place there, with the strapping loop (16) extending through the crack between the door (200) and door frame (201). The operator (100) grasps the handhold (11) and pulls his (100) or her (100) body upwards in traditional chin-up fashion. In the absence of the hand bracing pad assembly (2), the operator's (100) hands are likely forced uncomfortably against the door (200) with possible impairment of the exercise.

The hand bracing pad assembly (2), when present, comprises the pad itself (20), and any one of several pad connective means (25) for its (20) interconnection with the strapping loop (16) of the handhold and tethering assembly (1) at what is herein designated a strap intersection site where strapping is employed to make the connection.

The inventive assembly may comprise certain refinements such as by configuring the handhold (11) and tethering anchor (15) in cylindrical fashion, enwrapping a hard handhold core (12) in a compression sheath (13), comprising the strapping loop (16) with a length adjusting buckle (10) and providing the bracing pad (20) a cushioning core (24) and its opposing faces (28, 29) with pad covers (22, 23). For the sake of economy and part interchangeability, the handhold core (12) and tethering anchor (15) may be manufactured as duplicates of one another (12, 15).

BRIEF DESCRIPTION OF THE SEVERAL VIEWS OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

FIGS. 8 and 10 manage connections involving no pad connector strap (26), the first of these demonstrating a stitched attachment directly to the pad (20). The other, FIG. 10, comprises strap slits which are, in this instance, horizontally disposed. FIG. 9 illustrates riveted attachment. All three, nevertheless, exemplify variations in pad connective means (25).

DETAILED DESCRIPTION OF THE INVENTION

Figure 1:
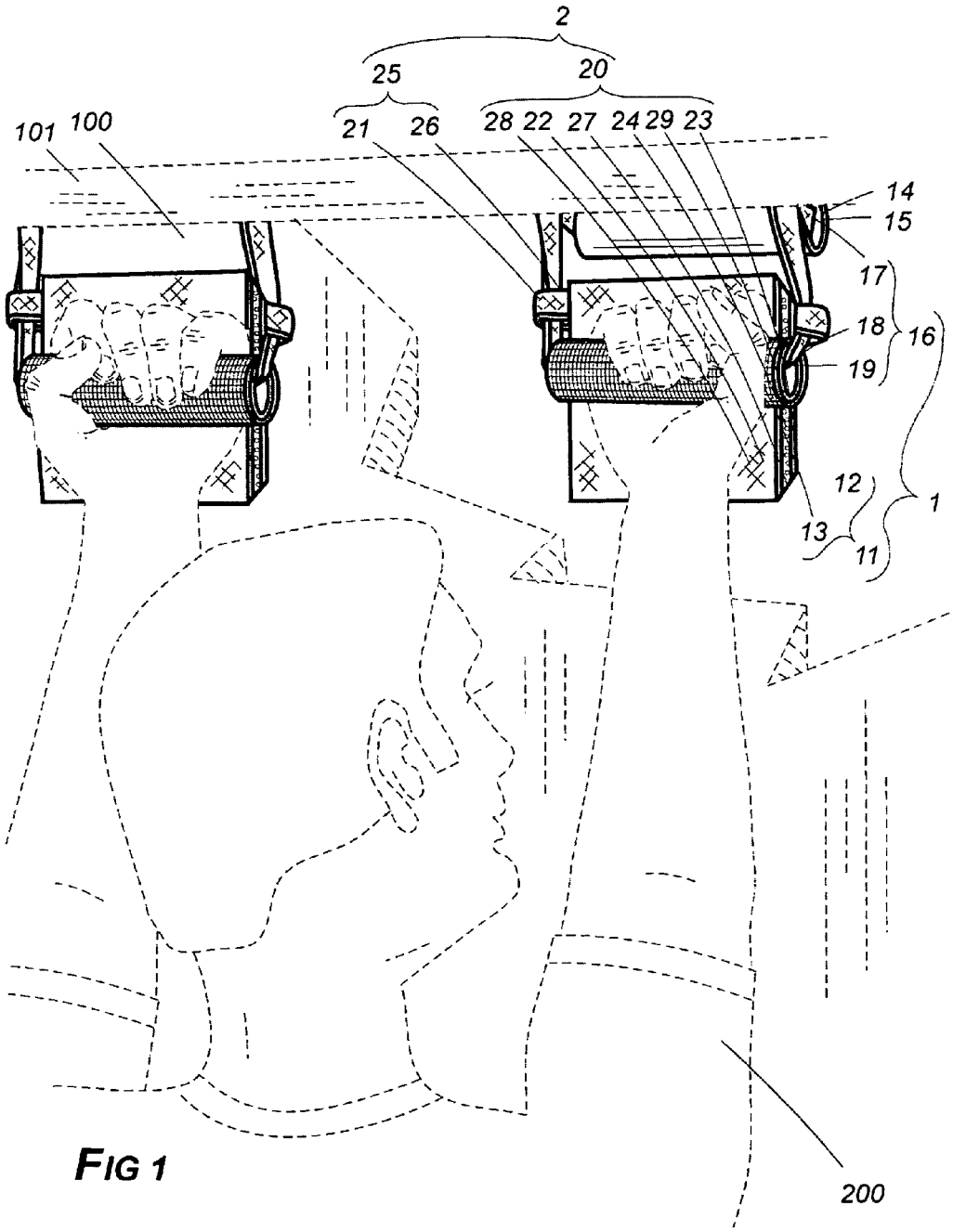
FIGS. 1 and 2 represent in perspective an embodiment of the invention showing, respectively, both operator (200) hand grasping versions, supra, upon the assembly's handhold (11). Both renderings disclose a paired hand bracing pad assembly (2) in which each pad (20) comprises a cushioning core (24) with door affronting and hand affronting pad covers (22, 23, respectively). The strapped interconnection of the two subassemblies (1, 2) at a strap intersection site is also disclosed. The door (100) is partially cut away to illustrate the cylindrical tethering anchor's (15) impinged retention while disposed against the closed door (100) and door frame (101).
Figure 2:
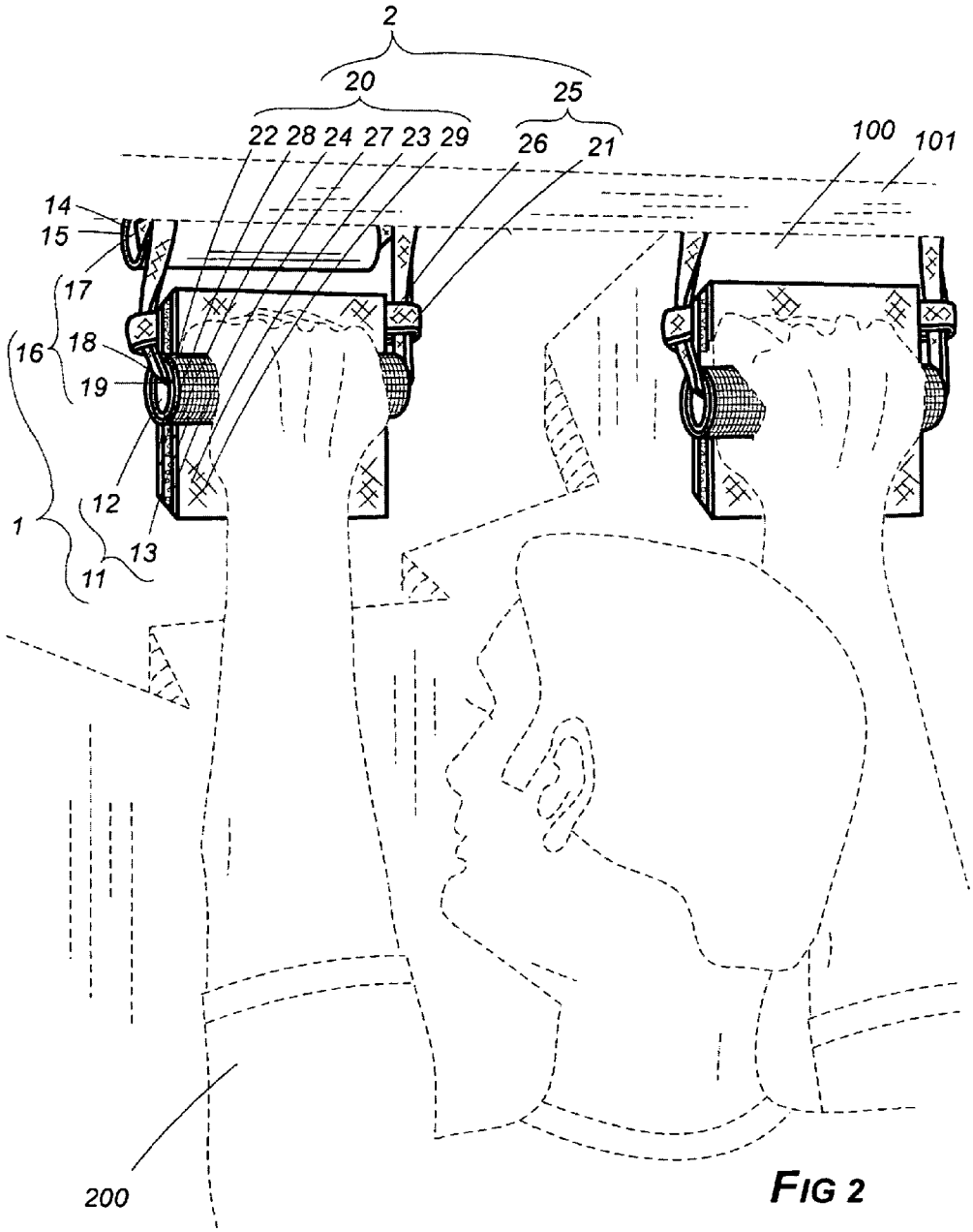
Figure 3:
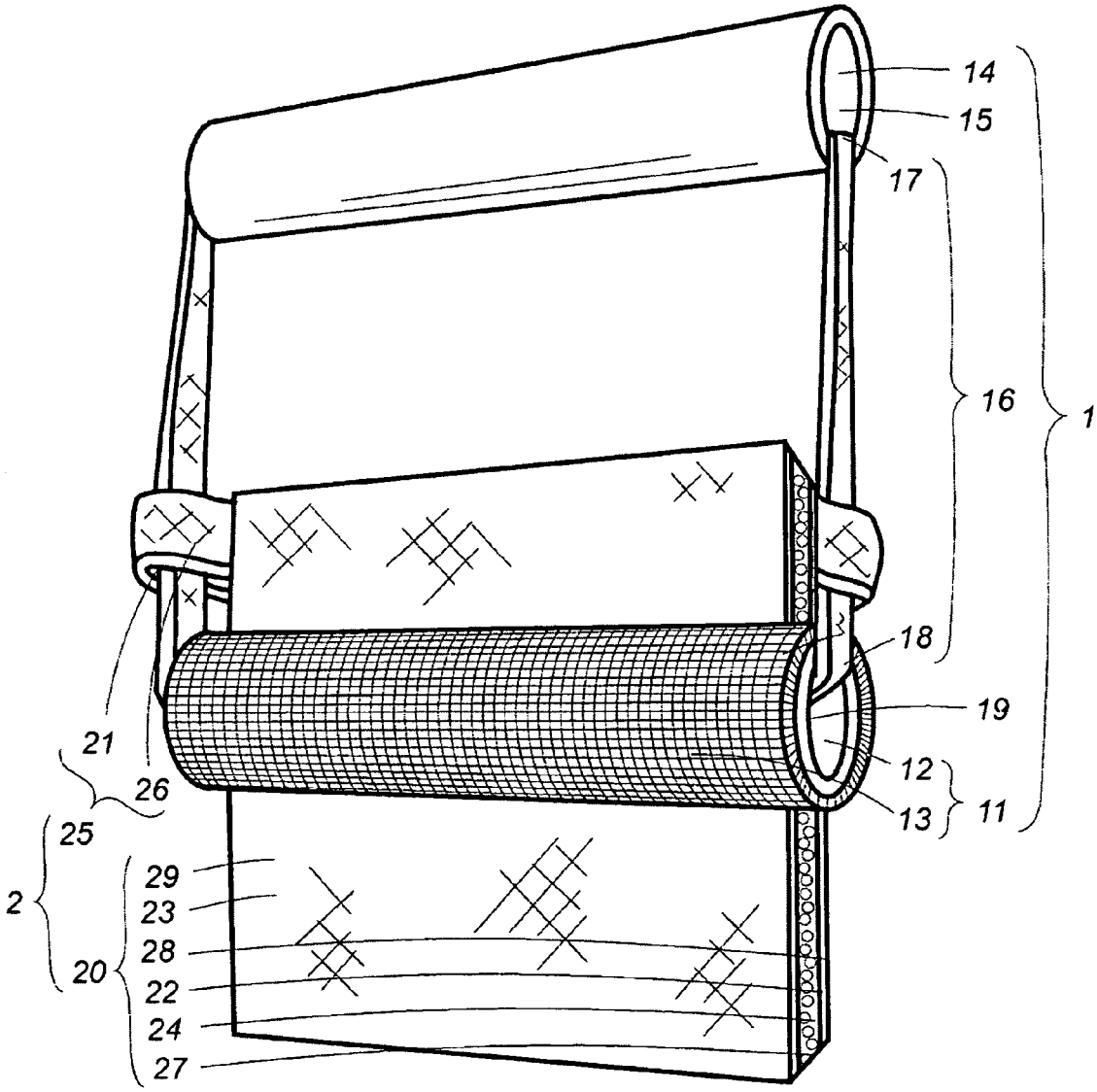
FIG. 3 represents a perspective front view of the inventive assembly.
Figure 4:
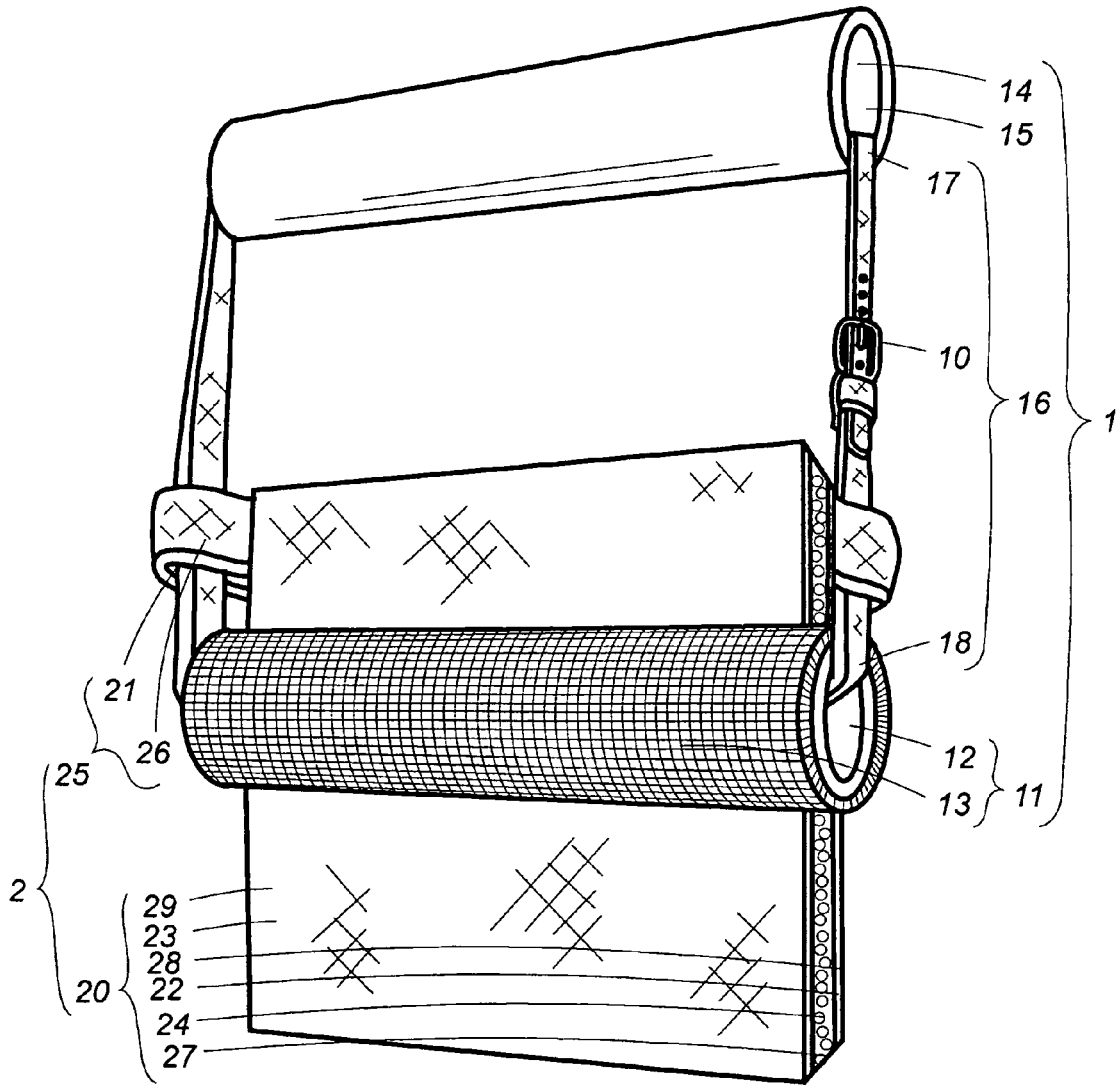
FIG. 4 illustrates a perspective front view of a version of the assembly wherein the strapping loop (16) additionally comprises a length adjusting buckle (10).
Figure 5:
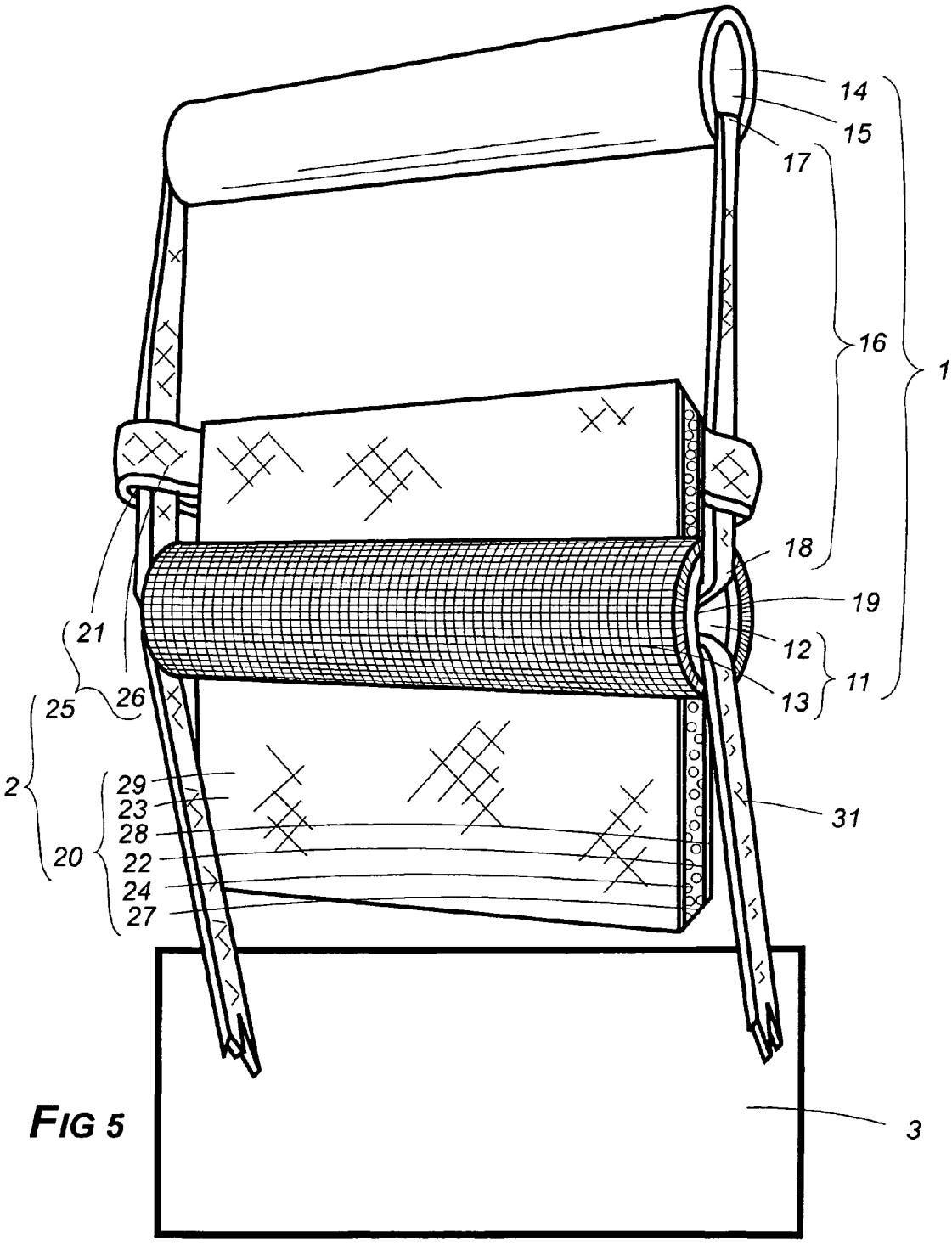
FIG. 5 is a perspective front view of a different version representing generically the addition thereto of a distal pull-exercise subassembly (3) illustrating in cut-away, strapping as its interconnecting media (31).
Figure 6:
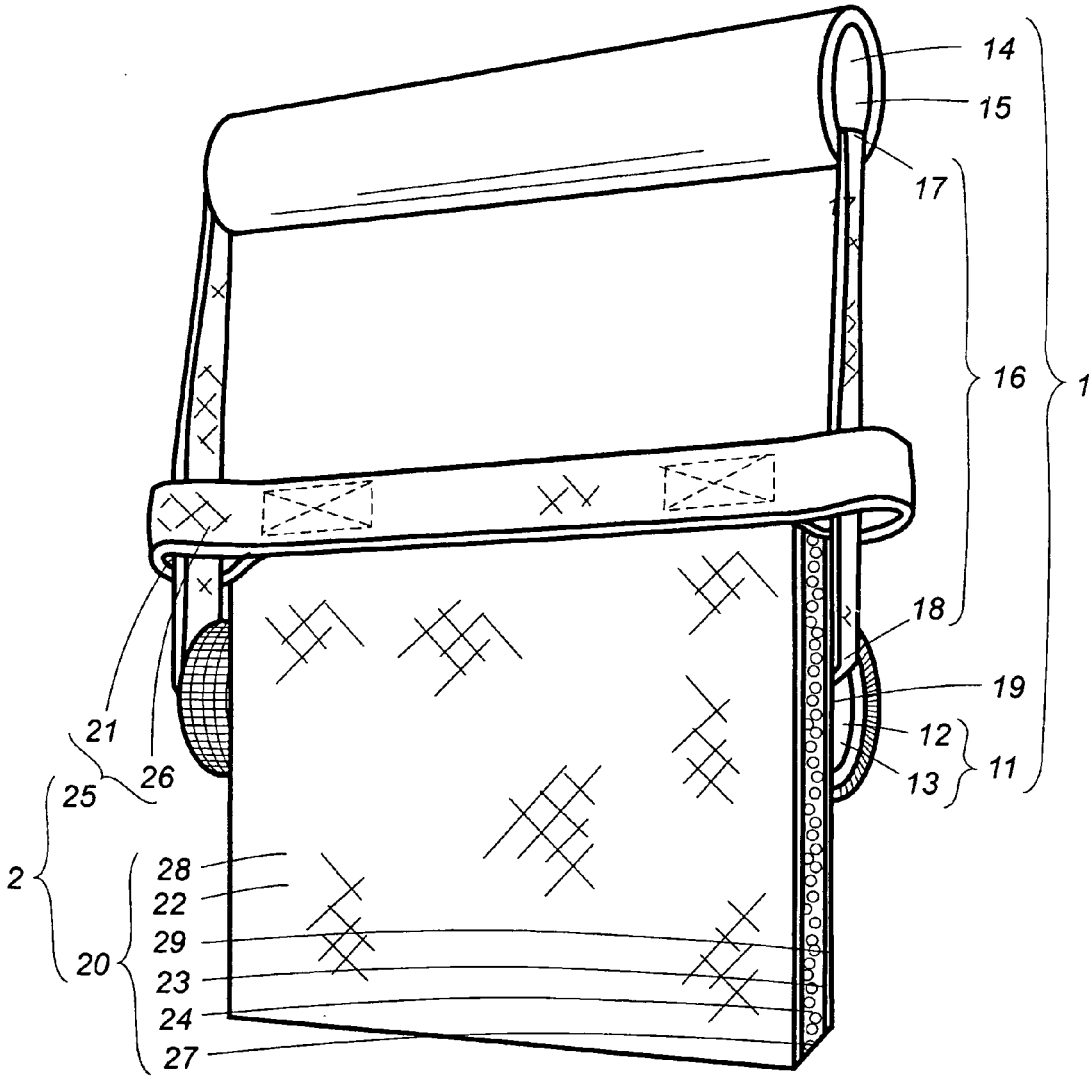
FIG. 6 illustrates a perspective rear view of the inventive assembly.
Figure 7:
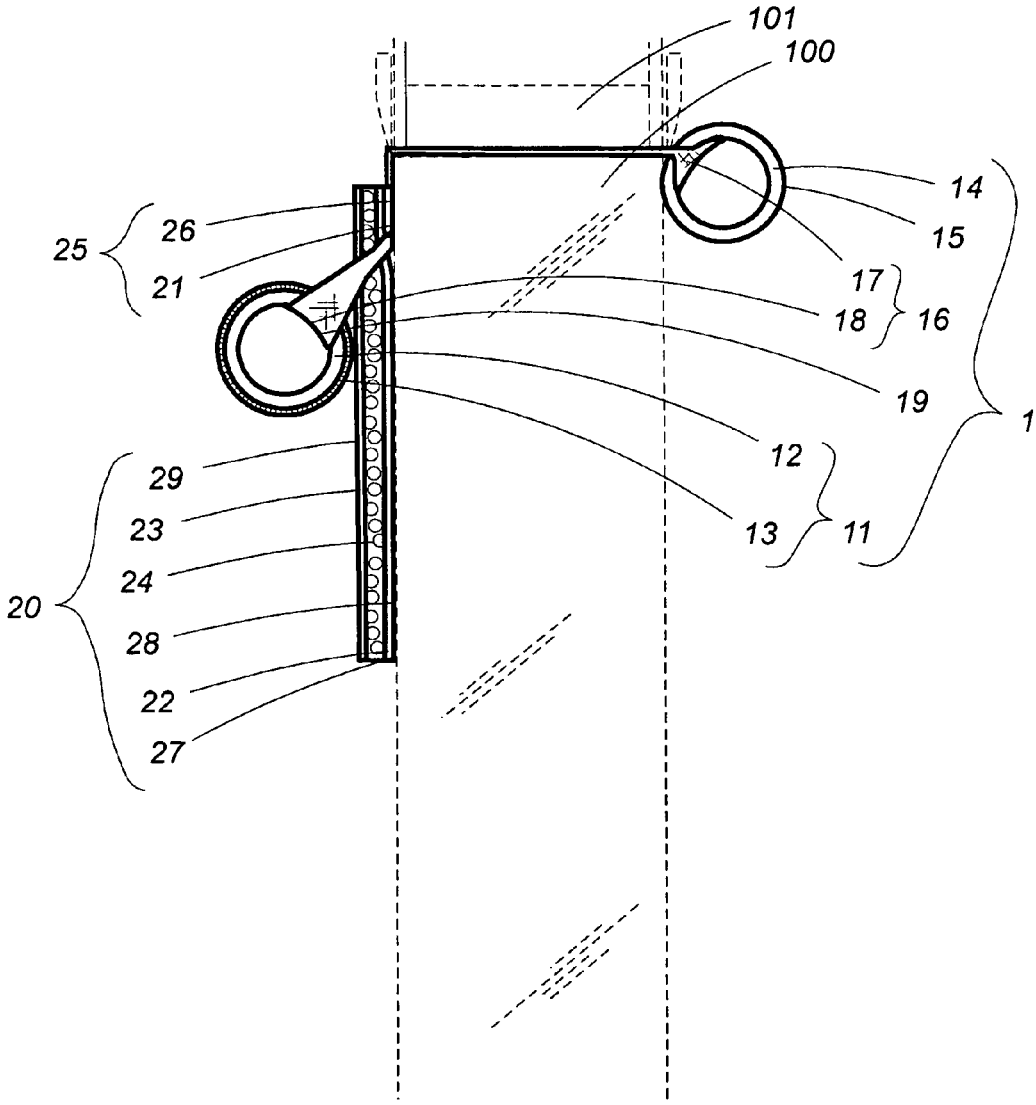
FIG. 7 comprises a side view of the assembly installed so as to be retained against the door (100) and its frame (101) in preparation for use.
Figure 8:
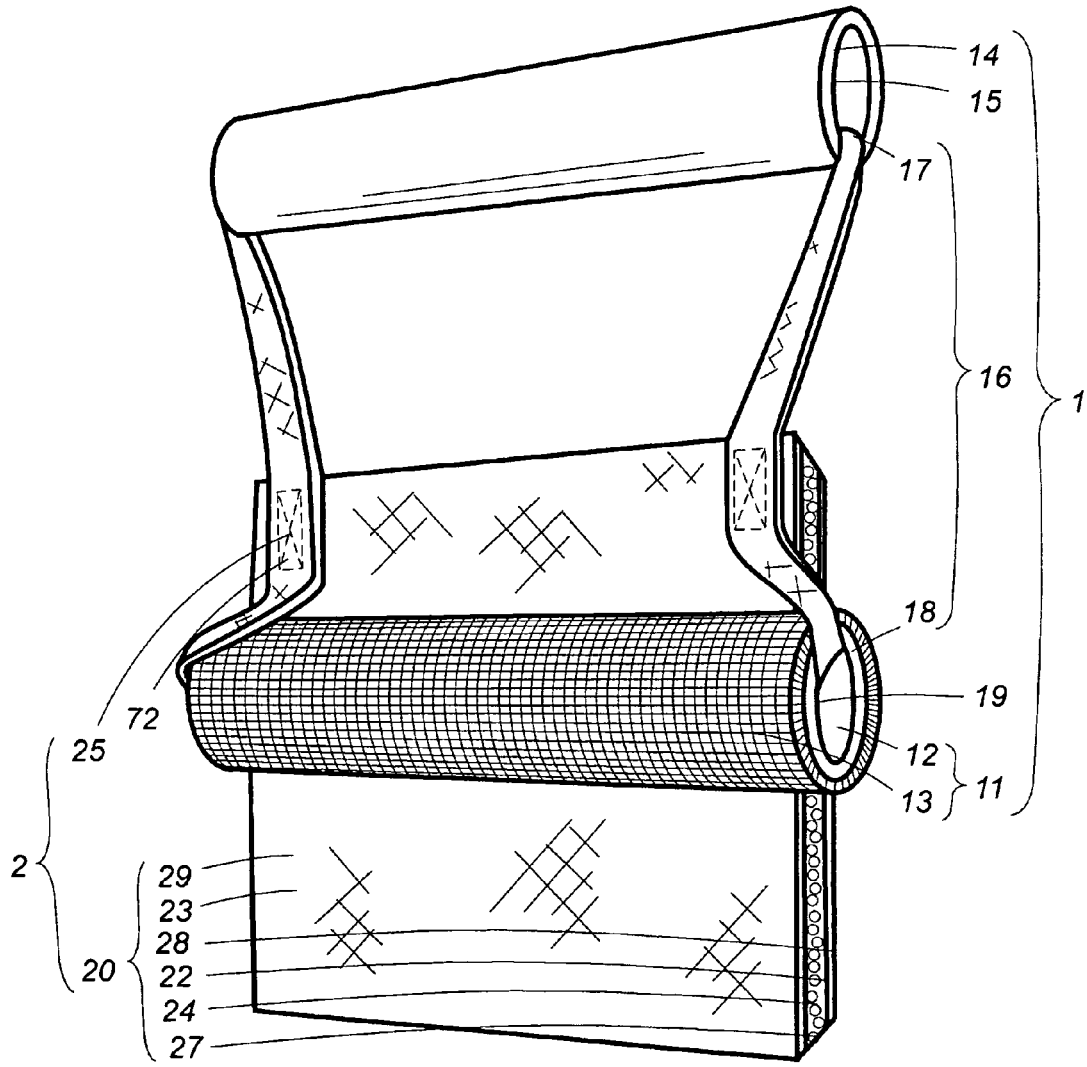
FIGS. 8-10 represent alternative but lesser preferred connection schemes between the strapping loop (16) and the bracing pad (20).
Figure 9:
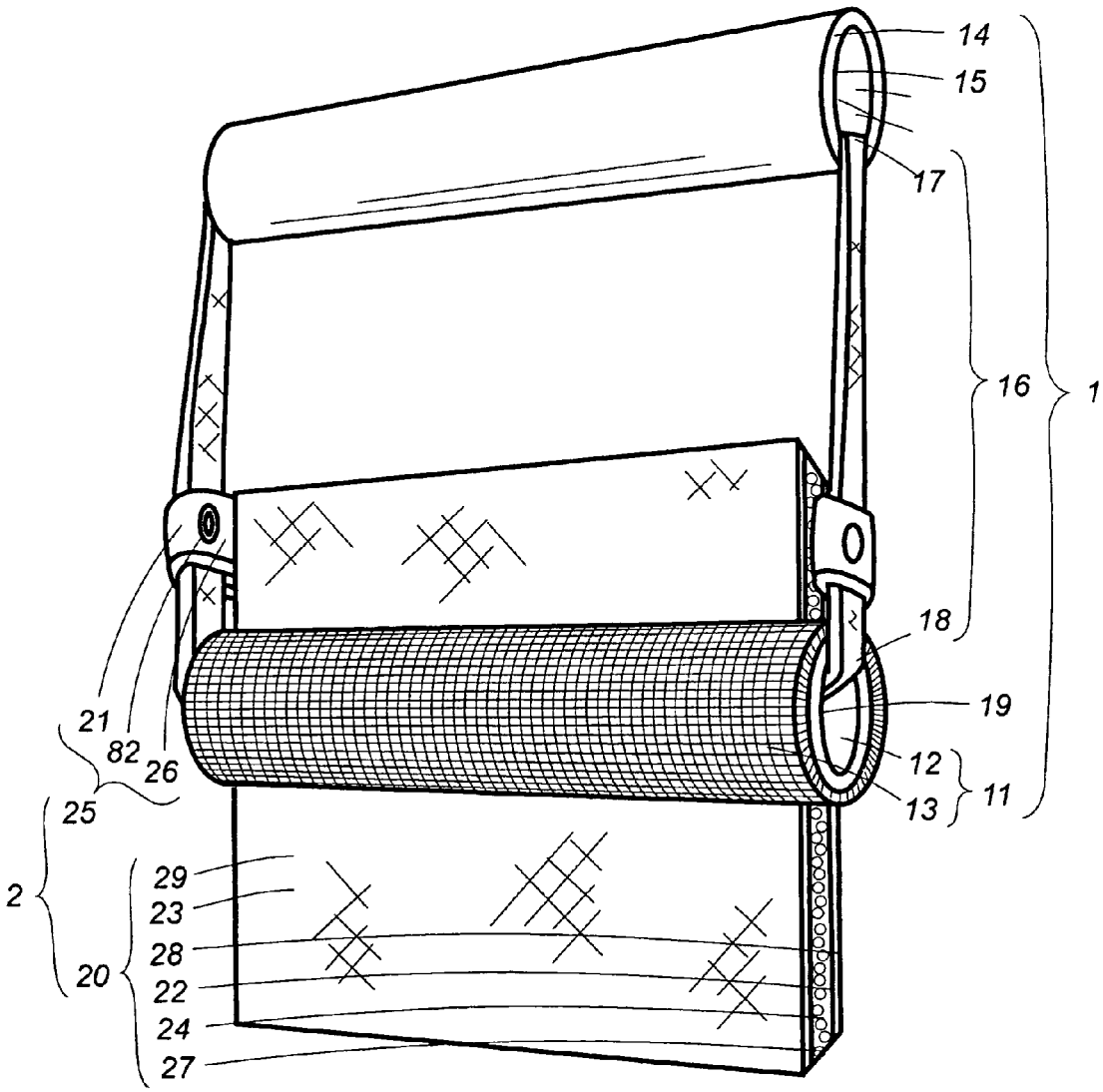
Figure 10:
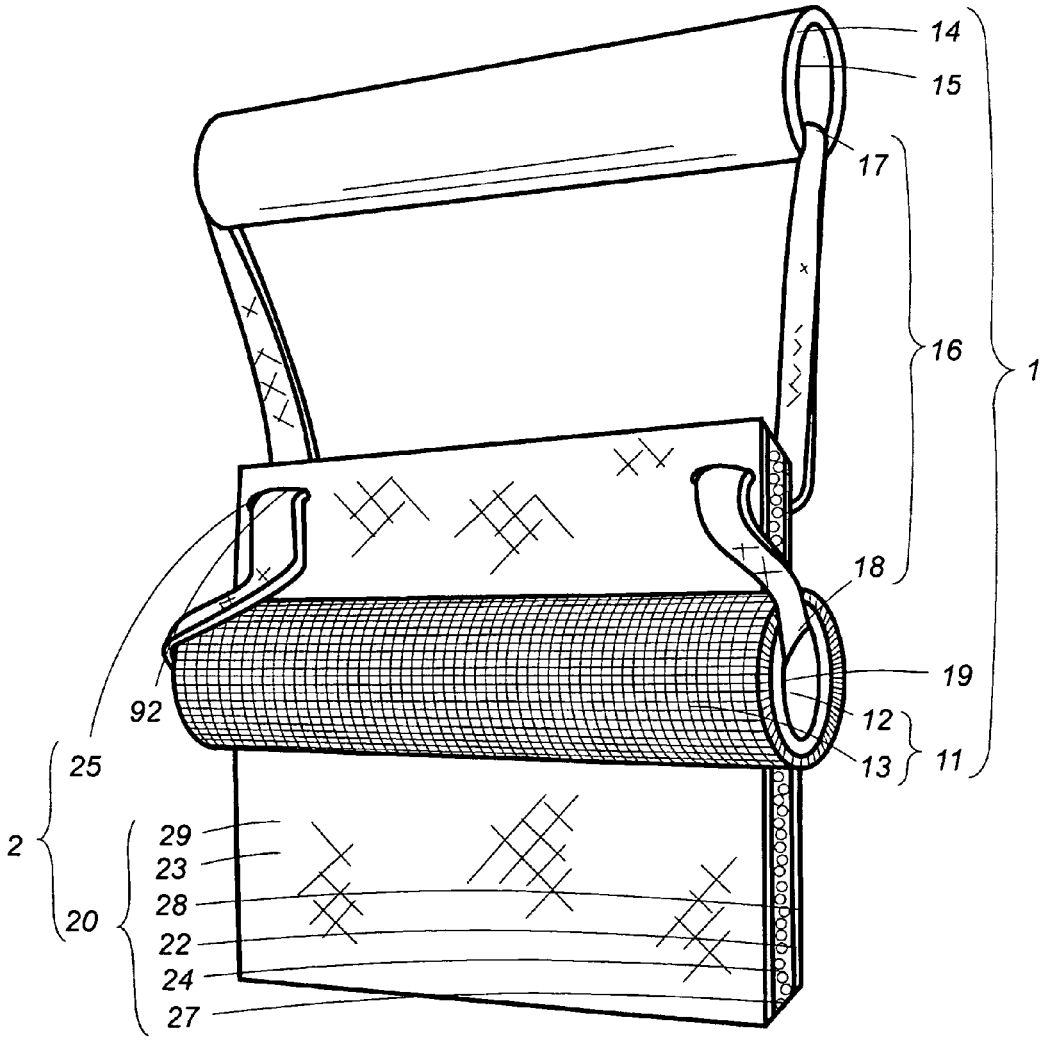

The subject of this application comprises in the main, a handhold tethering assembly (1) used for chin-up exercise either by itself or in conjunction with an additional hand bracing pad assembly (2) with which it (1) is interconnected by any of various means explained ante. A structural variant of the entire inventive arrangement also comprises as means to conduct reciprocal pulling exercises from a more distal vantage point, a pulling media subassembly (3)—any one of several known sorts—wherein the media (31) thereof is reeved through a tunneled member (11, 15), ante, or one of the paired sets of thereof (11, 15) with the media's (31) ends extending back to the operator (100).

The handhold and tethering assembly (1) comprises a tunneled handhold (11), a tunneled door impinged tethering anchor (14) and a strapping loop (16). Usually configured continuously in a closed ring or belt-like manner, the loop (16) is reeved through the tunnels within the handhold (11) and tethering anchor (15) and, if present, ante, certain parts of the hand bracing pad assembly (2). Once that is done, its (16) ends are mutually attached in many cases to complete the ring. The portions of the loop (16) oppositely disposed by extension through the tunnels of the handhold (11) and tethering anchor (15) comprise first and second sectors (17, 18, respectively). In some cases, however, a buckle (10) permitting shorter or longer strap length is incorporated within the loop (16), obviating any need for preliminary attachment to form the continuous ring. It is, accordingly, stated for those variants that the loop (16) in turn comprises a length adjusting buckle (10) disposed within it (16).

Composition of plastic or the like, if such material is employed, requires stapling, riveting, using an adhesive or preferably, heat welding. Strong fabric strapping, preferred over plastic or the like, is best attached by stitching at a sewn sector, although any of the alternative attachment means is acceptable. The length of the strap should be such as to dispose the handhold (11) at a challenging height when the tethering anchor (15) is impinged at the opposing side of the door (100) against the top thereof (100) and the doorframe (101).

As its (11) name suggests, the handhold (11) comprises a tunneled core (12) preferably of relatively hard durable composition. Although materials of less flexibility are workable, a stiff unyielding construction provides more acceptable exercises. The diameter of the core's tunnel (12) must, of course, be sufficient to accommodate the strapping loop's (16) enreevement.

The hand bracing pad assembly (2) comprises, similarly in pairs, a bracing pad (20), in turn comprising what are herein designated a door affronting face (28), an oppositely disposed hand affronting face (29) and pad edges (27) disposed at the perimeter thereof (20). The pad's faces (28, 29) may comprise any given configuration—be it a rectangle, square, circle, oval or any other geometric or even irregular shape. Pad connective means (25)—that is, means of connecting the pad (20) to the strapping loop (16)—are laterally disposed as members of an opposing pair proximate the pad's edges (27) and intermediate the tethering anchor (14) and the handhold (11) so as to dispose the pad's door affronting face (28) for abutment against the door (200) and the hand affronting face (29) proximate the handhold (11).

The connective means (25), thus, permit connection between the invention's two subassemblies—the handhold and tethering assembly (1) and the hand bracing pad one (2) at an intersection site—herein referred to as a strap intersection site where the connective media comprises strapping. The means (25) may acceptably be nothing more than opposing attachments between them (1, 2) but preferably comprise what are herein designated connector eyelets (21), thus, permitting convenient reference to the pad (20) as an eyeletted one (20). The eyelets (21) may comprise any suitable configuration but must be of sufficient size to accommodate the strapping loop (16)—that is, must allow the loop (16) to pass through them (21). They (21) may comprise merely (82), riveted rings (92) or any other means for the connection such as by stitching at an acceptable sewn sector (72). Preferably, the interconnection should be a loose one, allowing the pad (20) to move up and down the loop (16) freely. In use, the pad (20) then merely slips downward in response to gravity to become conveniently disposed proximate the operator's (100) hand.

Most preferably, the eyelets (21) are formed as part of a pad connector strap (26) attached to the pad (20). Experience has shown that to comprise suitable connective means (25), a connector strap (26) of suitable length may be doubled back upon itself (26) to form the opposing eyelets (21), disposed as ears at the lateral pad edges (27) and then be attached to some upper portion of the pad (20)—preferably at a sewn sector near the top. Even though connector eyelets (21) may permit a loosened relationship between them and the strapping loop (16), by definition herein, supra, the connection is properly considered one of rigid emplacement.

Alternative, albeit less preferable, arrangements are feasible for connection of the strapping loop (16) to the bracing pad (20). Connection can be made sans pad connection strap (26) altogether—for example, by stitched attachment of the loop (16) at a sewn sector to either of the pad covers (22, 23), if present, or to the pad itself (20). Otherwise, the strapping loop (16) may be reeved through strap slits (92) cut directly through the pad (20), thereby enabling a looser connection. In instances in which a tight attachment is desired, staples or, more preferably, rivets (82) may be employed with or without the connection strap (26).

The hand bracing pad (20) preferably comprises a cushioning core (24) with composition of foam or the like to better alleviate pressure upon the exercising operator's (100) hand at its locus of tension. Where the interior of the pad (20) is of such softened composition, it is preferable for the sake of avoiding undue wear to coat its faces (28, 29) with protective covering. A coating fabricated upon the door affronting face (28) is, thus, designated a door affronting pad cover (22) and that upon the opposing face (29), the hand affronting face cover (23). The latter (23) is preferably of tougher construction than that of the former (22) to meet endurance requirements relating to pressured abutment against the door (200).

The handhold (11) preferably comprises cylindrical configuration, its hollow core (12) enwrapped by a compressible sheath (13)—foam or otherwise—to provide the operator (100) a comfortable grip. So too, might the tethering anchor (15) be shaped cylindrically. Preferably, for manufacturing economy and convenience in interchangeability, the core (12) and anchor (15) are of identical configuration, comprising them duplicates of one another (12, 15).

Whenever desiring to instead undertake pulling-type exercises, the operator (100) may run the media (31) of a given pulling exercise assembly either through a singular tunneled handhold (11), through both handholds (11) comprising the pair provided for chin-ups, through a singular cylindrical tunneled tethering anchor (15) or through both such anchors (15) set in place as a pair. The exercise media (31) used for such purposes may be stretchable cord or sheeting or either stretchable or non-stretchable strapping or other suitable material. This arrangement provides what is herein designated a pulling media subassembly (3). For this arrangement, it is only necessary to assure that the cylinders (11, 15) are of sufficient inside diameter to permit enreevement of the media (31).

The inventor hereby claims:

1. A door mounted chin-up assembly comprising in pairs, one for each of an operator's left and right hands, a handhold and tethering assembly, each handhold and tethering assembly comprising:

a tunneled handhold;

a tunneled tethering anchor;

a strapping loop;

and a hand bracing pad assembly;

wherein a first sector of the strapping loop is disposed by extension through the tethering anchor and a second sector of the strapping loop is disposed by extension through the handhold;

and the hand bracing pad assembly comprises a hand bracing pad comprising a hand affronting face, door affronting face and pad edges, wherein laterally opposing portions of the pad comprise pad connective means for connection to the strapping loop, each of the pad connective means disposed intermediate the tethering anchor and the handhold so as to dispose the hand affronting face of the hand bracing pad proximate the handhold and the door affronting face of the hand bracing pad for abutment against the door, with the hand bracing pad extending between opposing sides of the strapping loop from the pad connective means to a location beyond the handhold;

whereby the operator, by disposing the tethering anchor by door blocker obstruction against the opposing side of a closed door may perform chin-ups and other body suspension exercises upon the door with the operator's hands cushioned from direct contact with the door.

2. The door mounted chin-up assembly according to claim 1 wherein the tunneled handhold is cylindrically configured and further comprises a compressible sheath.

3. The door mounted chin-up assembly according to claim 1 wherein strapping ends are mutually attached at a sewn sector to provide the looped configuration to the strapping.

4. The door mounted chin-up assembly according to claim 1 further comprising a length adjusting buckle wherein the strapping loop may be lengthened or shortened.

5. The door mounted chin-up assembly according to claim 1 wherein the tunneled tethering anchor and handhold are configured as duplicates of one another;

whereby the distinctive parts for assembly during manufacture are reduced in number and interchangeable.

6. The door mounted chin-up assembly according to claim 1 further comprising a pulling media subassembly wherein exercise media is reeved through one of a tunneled handhold, both tunneled handholds of a pair thereof, a cylindrical tunneled anchor, or both tunneled anchors set in place as a pair;

wherein an operator may undertake reciprocal distal pulling exercises.

7. The door mounted chin-up assembly according to claim 1 wherein the hand bracing pad is configured to further comprise a cushioning core and to dispose a door affronting pad cover upon the door affronting face thereof and a hand affronting pad cover upon its face.

8. The door mounted chin-up assembly according to claim 3 wherein the hand bracing pad's connective means to the strapping loop comprises eyeletted pad straps and the strapping loop extends loosely through respective opposing eyelets thereof while, nevertheless, comprising the connection one of rigid emplacement.

9. The door mounted chin-up assembly according to claim 3 wherein the hand bracing pad's connective means to the strapping loop comprises stitched attachment at a sewn sector.

10. The door mounted chin-up assembly according to claim 3 wherein the hand bracing pad's connective means to the strapping loop comprises riveting.

* * * * *

UNITED STATES PATENT AND TRADEMARK OFFICE
Certificate

Patent No. 7,601,100 B1 Patented: October 13, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert Sylvester Hinds, Madison, WI (US); and Jon Harrington Hinds, Madison, WI (US).

Signed and Sealed this Eighteenth Day of February 2014.

LOAN H. THANH
*Supervisory Patent Examiner*
Art Unit 3764
Technology Center 3700